US006460347B1

(12) United States Patent
Fujiyama et al.

(10) Patent No.: US 6,460,347 B1
(45) Date of Patent: Oct. 8, 2002

(54) STIRLING REFRIGERATING MACHINE

(75) Inventors: Norihide Fujiyama; Tadashi Kousaka; Takazo Sotojima, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 08/776,008

(22) PCT Filed: May 23, 1996

(86) PCT No.: PCT/JP96/01411

§ 371 (c)(1),
(2), (4) Date: Jan. 16, 1997

(87) PCT Pub. No.: WO96/39599

PCT Pub. Date: Dec. 12, 1996

(30) Foreign Application Priority Data

Jun. 5, 1995 (JP) ..... 7-138005

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 4,526,008 A * 7/1985 Taylor, Sr. ..... 62/6
4,570,983 A 2/1986 Olenfalk et al.
4,697,113 A 9/1987 Young
4,713,939 A * 12/1987 Keith ..... 62/6
4,761,960 A 8/1988 Higham et al.
4,862,695 A 9/1989 Kushnier
4,969,804 A 11/1990 Gannaway

FOREIGN PATENT DOCUMENTS

| | | |
|---|---|---|
| EP | 0465702 | 1/1992 |
| EP | 0494653 | 7/1992 |
| JP | 63148057 | 6/1988 |
| JP | 4143551 | 5/1992 |
| JP | 5106927 | 4/1993 |
| JP | 5126042 | 5/1993 |
| JP | 6174321 | 6/1994 |
| JP | 6 69663 | 9/1994 |

* cited by examiner

*Primary Examiner*—Ronald Capossela
(74) *Attorney, Agent, or Firm*—Nixon Peabody LLP; Donald R. Studebaker

(57) ABSTRACT

Insertion holes (3*c*, 4*e*) into which a connection pipe (9) are inserted are formed from a casing (3) to a cylinder (4). The connection pipe (9) has a flange (9*a*) formed on the outer periphery at a set distance from the end of the connection pipe (9). With the flange (9*a*) in contact with the wall outer surface of the casing (3), the end part of the connection pipe (9) is inserted into the insertion holes (3*c*, 4*e*). Between the flange (9*a*) and the wall outer surface of the casing (3), an O-ring (01) is fit so as to surround an internal passage (9*f*) of the connection pipe (9). Another O-ring (02) is fit between the end part of the connection pipe (9) and the insertion hole (4*e*) of the cylinder (4).

5 Claims, 6 Drawing Sheets

STIRLING REFRIGERATING MACHINE

TECHNICAL FIELD

This invention relates to a Stirling refrigerating machine in which a compressor is connected to an expander through a connection pipe, and particularly relates to improvements of a sealing structure provided at a joint between the compressor and the connection pipe.

BACKGROUND ART

A free displacer type Stirling refrigerating machine has been conventionally known as one of small size refrigerating machines which produce cold conditions at an extremely low temperature level. Such a refrigerating machine is disclosed in Japanese Patent Application Laid-Open Gazette No. 6-174321. The refrigerating machine is so composed that a compressor for compressing a gas refrigerant and an expander for expanding the gas refrigerant discharged from the compressor are connected to each other through a connection pipe.

Below, description will be made about the structure of the compressor.

As shown in FIG. 6, the compressor (a) includes a gastight casing (b), a cylinder (c) provided in the casing (b), a pair of pistons (e, e) reciprocatably fit in the cylinder (c) to form a compression room (d) in the cylinder (c), and linear motors (f, f) for reciprocating the pistons (e, e) respectively. The cylinder (c) has cylindrical recesses (c1, c1). The recesses (c1, c1) are formed around the compression room (d) in a manner coaxial with the cylinder (c).

The linear motor (f) has an annular permanent magnet (g) disposed in the recess (c1). The permanent magnet (g) generates a magnetic field with the cylinder (c) serving as a yoke. An inverted-cup-shaped bobbin (h) is reciprocatably placed in the recesses (c1). The bobbin (h) is provided with a drive coil (i). The drive coil (i) is opposed to the permanent magnet (g). The bobbin (h) is fixed at a center thereof to the piston (e). A lead (k) for supplying a current to the drive coil (i) is led out of the bobbin (h). The lead (k) is connected to a terminal (m) mounted on the casing (b). The outer bottom surface of the bobbin (h) (a side opposite to the piston) and the inner bottom surface of the casing (b) are bridged with a piston spring (j) formed of a coil spring. The piston spring (j) resiliently supports the piston (e) so as to allow reciprocating motions of the piston (e).

A gas passage (c2) is formed in the cylinder (c) and the casing (b). The gas passage (c2) is open at one end thereof to the compression room (d) and at the other end to the outer surface of the casing (b).

The compressor (a) is connected to one end of a connection pipe (n), so that the internal passage of the connection pipe (n) is communicated with the gas passage (c2). The other end of the connection pipe (n) is connected to an expander (not shown).

In operating the refrigerating machine, an alternating current of a specific frequency is supplied to the drive coils (i, i) through the leads (k, k). Thereby, a magnetic field generated around the drive coils (i, i) acts to reciprocate the bobbins (h, h). Attendantly, the pistons (e, e) lineally reciprocate in the cylinder (c) in opposite directions, so that a compressed gas generates in the compression room (d) in cycles. A pressure of a gas refrigerant thus compressed is introduced to the expander through the connection pipe (n). Thus, a high pressure and a low pressure repeatedly acts on the expander. In the expander, a gas refrigerant is expanded so that a cold condition is produced.

PROBLEM THAT THE INVENTION IS TO SOLVE

In such kind of refrigerating machine, it is required to maintain its operating performance at a high level. To satisfy the requirement, a compressed gas generated in the compressor (a) must be efficiently transferred to the expander. To cope with this, necessary positions surrounding the gas passage (c2) each have a sealing structure for preventing a leakage of a compressed gas.

Below, the conventional sealing structure will be described.

As shown in FIG. 7, O-rings (o, p, p) are disposed at a joint between the casing (b) and the connection pipe (n) and a contact part between the casing (b) and the cylinder (c), respectively. First, description is made about the sealing structure of the joint between the casing (b) and the connection pipe (n). A mount (b1) having a plain mounting surface is formed on the outer surface of the casing (b), while a plate-shaped flange (n1) is formed at one end of the connection pipe (n). A sealing groove (n2) is formed on the flange (n1). The sealing groove (n2) is annular and surrounds the internal passage of the connection pipe (n). A single O-ring (o) is inserted in the sealing groove (n2). The mount (b1) and the flange (n1) each have unshown screw holes. The gas passage (c2) is aligned with the internal passage of the connection pipe (n), and in this state the flange (n1) is brought into contact with the mounting surface of the mount (b1). Thereafter, screws (q, q) are screwed in both the screw holes, so that the connection pipe (n) is connected to the compressor (a). In this structure, since the single O-ring (o) is interposed between the flange (n1) and the mount (b1), this prevents a gas refrigerant flowing through the gas passage (c2) from leaking out of a clearance between the flange (n1) and the mount (b1) (See arrow A in FIG. 7).

Next, description is made about the sealing structure of the contact part between the casing (b) and the cylinder (c). Sealing grooves (c3, c3) are formed at both sides (right and left in FIG. 7) of the gas passage (c2) of the cylinder (c). The sealing grooves (c3, c3) are formed over the circumference of the cylinder (c). The cylinder (c) is inserted into the casing (b) with O-rings (p, p) (two in total) fit into the sealing grooves (c3, c3) respectively. In this structure, the two O-rings (p, p) are interposed between the outer periphery of the cylinder (c) and the inner periphery of the casing (b). Accordingly, a gas refrigerant flowing through the gas passage (c2) is prevented from leaking out of a clearance between the cylinder (c) and the casing (b) to the inner space of the casing (b) (See arrow B in FIG. 7).

However, the above sealing structure has the following problems: In the structure, a sealed part between the casing (b) and the cylinder (c) is formed over the circumference of the cylinder (c). In other words, the O-rings (p, p) each having a large diameter identical with the outer diameter of the cylinder (c) are used. Therefore, a sealed area becomes large. This makes it difficult to obtain a sufficient reliability of a sealing function, that is, the possibility that a gas refrigerant may leak out of the contact part between the casing (b) and the cylinder (c) to the inner space of the casing (b) is increased.

The present invention has been made in view of the above problem. An object of the invention is to increase a reliability of a sealing function of a contact part between a casing and a cylinder in a compressor of a Stirling refrigerating machine.

DISCLOSURE OF INVENTION

SUMMARY OF THE INVENTION

In the present invention, an end part of a connection pipe is inserted into insertion holes formed in a casing and a cylinder respectively. Then, a sealing function is provided to a joint between the end part of the connection pipe and the cylinder. In this arrangement, a sealed area is decreased, resulting in increase in reliability of the sealing function of the contact part between the casing and the cylinder.

FEATURES OF THE INVENTIONS

More specifically, a solution taken in claim 1 of the invention is described below. As shown in FIGS. 1 and 3, the solution is directed to a Stirling refrigerating machine having a compressor (1) and an expander (2). The Stirling refrigerating machine premises the following structure: The compressor (1) comprises, a cylinder (4) fit into a casing (3), a piston (6) which is inserted into the cylinder (4) so as to be capable of reciprocating motion relative to the cylinder (4) and forms a compression room (7) between the piston (6) and the cylinder (4), resilient means (14) for resiliently supporting the piston (6) on the casing (3), and drive means (10) for driving the piston (6) into reciprocating motion relative to the cylinder (4). The compression room (7) is communicated with the expander (2) through a connection pipe (9). The drive means (10) relatively reciprocates the piston (6) with respect to the cylinder (4) so that a compressed fluid generated in the compression room (7) is introduced into the expander (2) through the connection pipe (9).

The casing (3) has an insertion hole (3*c*) which penetrates the casing (3) and whose one end is open to an outer surface of the casing (3), while the cylinder (4) has an insertion hole (4*e*) which is communicated at one end with the insertion hole (3*c*) of the casing (3) and at the other end with the compression room (7).

Further, a compressor (1) side joint end part of the connection pipe (9) is inserted into the insertion hole (3*c*) of the casing (3) and the insertion hole (4*e*) of the cylinder (4) to communicate an internal passage (9*f*) of the connection pipe (9) with the compression room (7).

Furthermore, sealing means (02, 28) are interposed between the compressor (1) side joint end part of the connection pipe (9) and the insertion hole (4*e*) of the cylinder (4).

A solution taken in claim 2 of the invention is so composed that in the Stirling refrigerating machine of claim 1, as shown in FIG. 3, an annular sealing groove (9*d*) is formed on one of the outer periphery of the connection pipe (9) located in the insertion hole (4*e*) of the cylinder (4) and the inner periphery of the insertion hole (4*e*) of the cylinder (4) so as to extend in a circumferential direction of the periphery. The sealing means is formed of an O-ring (02) fit into the sealing groove (9*d*).

A solution taken in claim 3 of the invention has, in the Stirling refrigerating machine of claim 1, the following structure: As shown in FIG. 4, the cylinder (4) is provided with a gas passage (8) coaxial with the insertion hole (4*e*) of the cylinder (4) and having a smaller diameter than the insertion hole (4*e*) of the cylinder (4). The gas passage (8) is communicated at one end with the compression room (7) and at the other end with the insertion hole (4*e*) through a step part (4*f*). The inner periphery of the insertion hole (4*e*) of the cylinder (4) is formed into a female thread (4*g*), while the outer periphery of the compressor (1) side joint end part of the connection pipe (9) located in the insertion hole (4*e*) of the cylinder (4) is formed into a male thread (9*e*) screwed in the female thread (4*g*). The sealing means is formed of an O-ring (02) interposed between the end surface of the connection pipe (9) and the step part (4*f*).

A solution taken in claim 4 of the invention has, in the Stirling refrigerating machine of claim 1, the following structure: As shown in FIG. 5, the inner periphery of the insertion hole (4*e*) of the cylinder (4) is formed into a female thread (4*g*), while the outer periphery of the compressor (1) side joint end part of the connection pipe (9) located in the insertion hole (4*e*) of the cylinder (4) is formed into a male thread (9*e*) screwed in the female thread (4*g*). The sealing means is made of an adhesive agent (28) put in a clearance between the female thread (4*g*) and the male thread (9*e*).

A solution taken in claim 5 of the invention is so composed that in the Stirling refrigerating machine of claim 1, as shown in FIGS. 4 and 5, the connection pipe (9) has a flange (9*a*) formed in one piece with the connection pipe (9) and opposed to the outer surface of the casing (3) and a metal packing (27) is interposed between the outer surface of the casing (3) and the flange (9*a*).

OPERATIONS

In the above-mentioned feature of claim 1 of the invention, when the Stirling refrigerating machine is in operation, the drive means (10) causes reciprocating motion of the piston (6) relative to the cylinder (4), so that a pressure of fluid compressed in the compression room (7) is introduced into the expander (2) through the connection pipe (9). In this operating condition, the sealing means (02), (28) interposed between the compressor (1) side joint end part of the connection pipe (9) and the insertion hole (4*e*) of the cylinder (4) prevent the fluid from leaking out of a clearance between the connection pipe (9) and the cylinder member (4). A sealed area of the sealing means (02), (28) is a contact part between the connection pipe (9) and the insertion hole (4*e*) of the cylinder (4). Thus, the sealed area is limited to a small area of only a part of the outer periphery of the connection pipe (9) thereby implementing high-reliable sealing.

In the features of claims 2, 3 and 4 of the invention, specific structures of the sealing means (02), (28) are obtained and thereby improves the practicality of the sealing structure. Particularly, in the features of claims 3 and 4 of the invention, the male thread (9*e*) formed on the outer periphery of the connection pipe (9) is screwed in the female thread (4*g*) formed on the cylinder (4). This eliminates the need for separate screw structure or the like for mounting the connection pipe (9) on the cylinder (4). Further, in the feature of claim 4 of the invention, the sealing means is made of an adhesive agent (28). This allows the sealing means to display the function of increasing a strength of mounting the connection pipe (9) on the cylinder (4) as well as the sealing function.

In the feature of claim 5 of the invention, the function of sealing between the connection pipe (9) and the casing (3) is displayed by the metal packing (27) interposed between those members. This provides high sealing performance to the joint of the connection pipe (9) to the compressor (1) in association with the actions of the other claims above-mentioned of the invention.

EFFECTS OF THE INVENTION

According to claim 1 of the invention, an area sealed by the sealing means (02), (28) can be limited to a small area of only a part of the outer periphery of the connection pipe (9). This implements a more secure sealing as compared with the conventional case of providing sealing means over the entire circumference of the cylinder (4). Consequently, the reliability of the sealing function can be increased, thereby maintaining the operating performance of the refrigerating machine at a high level.

According to claims 2, 3 and 4 of the invention, the practicality of the sealing structure can be increased. In particular, according to claims 3 and 4 of the invention, a simple joint structure and a simple joint work of the connection pipe (9) can be implemented. Further, according to claims 3 and 4, a joint structure can be formed between the inner periphery of the insertion hole (4*e*) of the cylinder (4) and the outer periphery of the connection pipe (9). This eliminates the need for providing a large flange to be joined to the casing on the outer periphery of the connection pipe as in the conventional case. In addition, there is no need for providing, in the casing, a mount and screw holes for joint of the flange. Accordingly, the thickness of the casing can be decreased, resulting in downsizing and weight reduction of the entire compressor. Furthermore, according to claim 4 of the invention, the sealing means can have a function of increasing a strength of mounting the connection pipe (9) on the cylinder (4) as well as the sealing function. Consequently, the joint of the connection pipe (9) can secure the high reliability of the joint state.

According to claim 5 of the invention, in association with the above effects of the claims, the joint of the connection pipe (9) to the compressor (1) can obtain high sealing performance. This further increases the operating performance of the refrigerating machine.

BEST MODE FOR CARRYING OUT THE INVENTION

Below, description will be made about embodiments of the present invention with reference to the drawings.

EMBODIMENT 1

Figure 1:
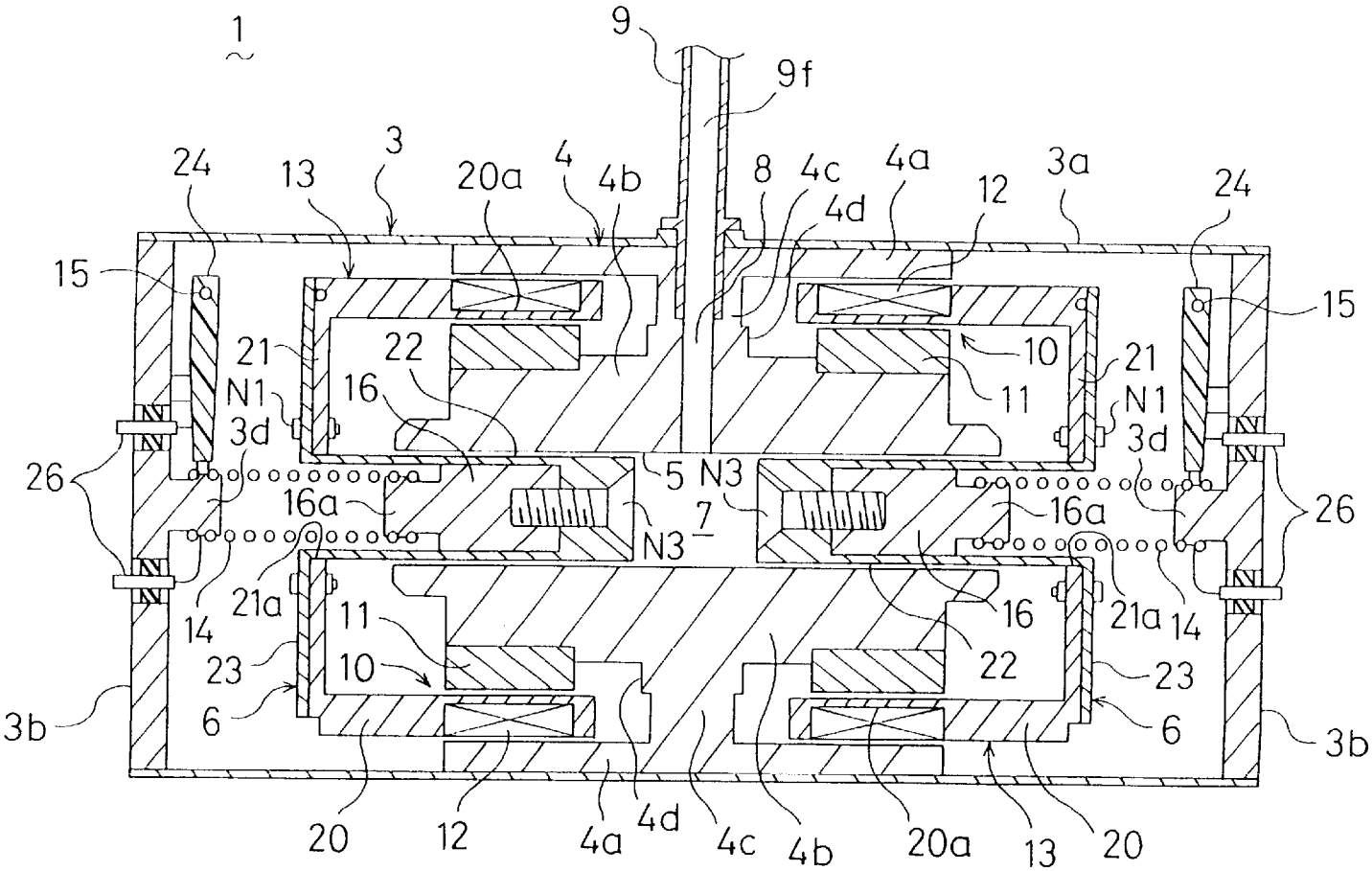
FIG. 1 is a cross section showing the internal structure of a linear motor compressor.
Figure 2:
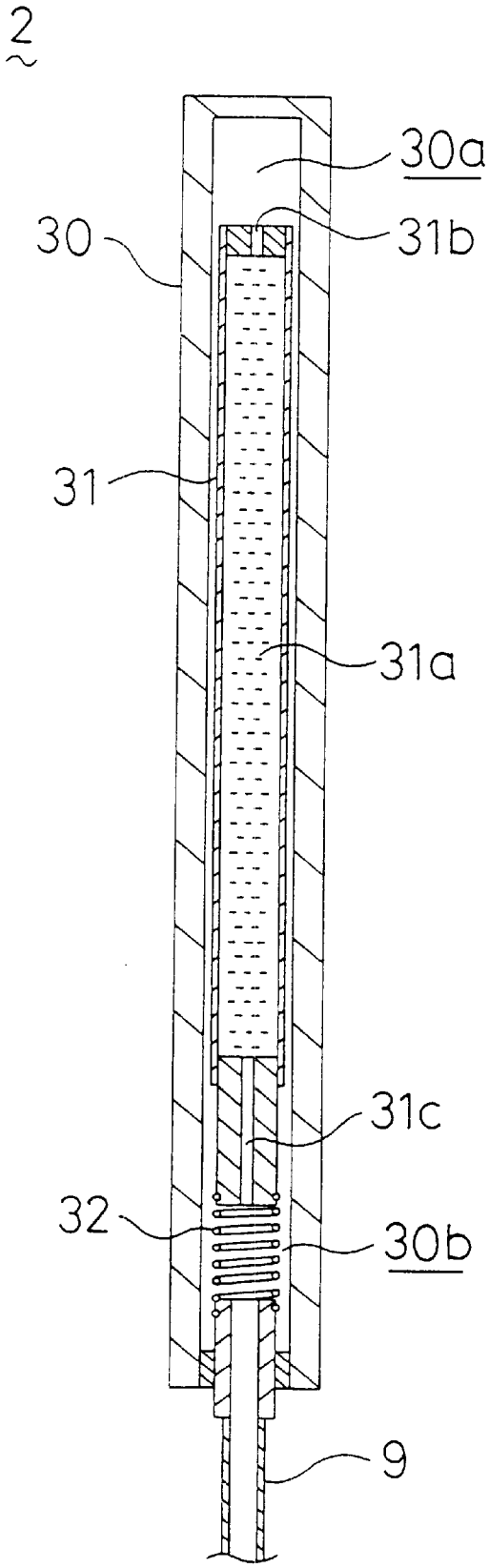
FIG. 2 is a cross section showing the internal structure of an expander.

FIGS. 1 and 2 show a linear motor compressor (1) and an expander (2) of a Stirling refrigerating machine according to the present embodiment, respectively. First, the compressor (1) is described. The compressor (1) is composed of an opposed-piston type reciprocating compressor. The compressor (1) has a gastight, cylindrical casing (3). The casing (3) consists of a cylindrical body (3*a*) and disc-shaped blocking plates (3*b*, 3*b*) for blocking both end openings of the cylindrical body (3*a*). A cylinder (4) is disposed in the casing (3). The cylinder (4) is made of pure iron. The cylinder (4) has an outer tube (4*a*) fixed on the wall inner surface of the casing (3) and an inner tube (4*b*) disposed inside the outer tube (4*a*) with a set distance left therebetween. The outer tube (4*a*) and the inner tube (4*b*) are connected to each other through a doughnut-shaped connection part (4*c*), so that recesses (4*d*) are formed between the outer tube (4*a*) and the inner tube (4*b*). The recesses (4*d*) each have a cylindrical form coaxial with the cylinder (4). The center of the inner cylinder (4*b*) is formed into a piston insertion hole (5).

Piston bodies (22, 22) of the piston (6, 6) are inserted into the piston insertion hole (5) from the right and left of FIG. 1, respectively. A space surrounded by both the piston bodies (22, 22) and the inner tube (4*b*) forms a compression room (7). The outer diameter of the piston body (22) is formed slightly smaller than the inner diameter of the inner tube (4*b*), so that a small clearance of, e.g., approximately 10 $\mu$m is formed between the piston body (22) and the inner tube (4*b*). The small clearance is sealed by an unshown clearance seal or fluid seal, thereby securely holding the hermeticity of the compression room (7).

In the cylinder (4), a gas passage (8) radially extending from the piston insertion hole (5) is formed. The gas passage (8) is open at an inner end thereof to the compression room (7). The gas passage (8) is communicated with an internal passage (9*f*) of the connection pipe (9). The compressor (1) and the expander (2) are connected to each other through the connection pipe (9).

The pistons (6, 6) are connected to linear motors (10, 10) as drive means for driving the pistons (6, 6) into reciprocating motion, respectively. The linear motors (10, 10) each have a permanent magnet (11) and a coil (12). The permanent magnet (11) is formed of a cylindrical magnet externally fit on the outer periphery of the inner tube (4*b*). In this arrangement, the permanent magnet (11) forms a magnetic circuit with the cylinder (4) serving as a yoke. That is, a magnetic field of a specific intensity is produced between those elements.

The pistons (6, 6) are supported to approximately inverted-cup-shaped bobbins (13, 13), respectively. The bobbins (13) each includes a cylindrical bobbin body (20) and a disc-shaped piston mounting part (21) provided at one side end of the bobbin body (20) (outer right and outer left ends of the bobbin bodies (20) of FIG. 1). A recessed coil wrapping part (20*a*) is formed at a position of the outer periphery of the bobbin body (20) corresponding to the permanent magnet (11). The coil (12) is wrapped around the coil wrapping part (20*a*). The center of the piston mounting part (21) is formed into an opening (21*a*) for inserting the piston body (22) therethrough.

The piston (6) has the piston body (22) in bottomed, cylindrical form and a flange (23) extending from a rear end of the piston body (22) (outer right and outer left ends of the piston bodies (22) of FIG. 1) toward the periphery.

The piston body (22) is inserted through the opening (21*a*) until the flange (23) is overlaid on the piston mounting part (21). Then, both the members (23, 21) are assembled into one piece by screws (N1, N1).

Between the piston (6) and the blocking plate (3*b*), a resin-made lead holding member (24) is disposed. The lead holding member (24) holds a part of a lead (15) for supplying an electric current to the coil (12). The lead (15) is connected at an outer end thereof to terminals (26, 26) provided in the blocking plate (3*b*) of the casing (3).

In the piston body (22), a spring mounting member (16) having a spring mount (16*a*) is inserted. At a front end of the piston body (22), a through hole is formed along the axis of the piston body (22). The spring mounting member (16) has a female thread formed at a position corresponding to the through hole. A screw (N3) is screwed into the female thread from the front end of the piston body (22), so that the spring mounting member (16) and the piston (6) are assembled into one piece. The blocking plate (3*b*) of the casing (3) is provided at a center thereof with a spring mount (3*d*) identical in form with the spring mount (16*a*). A spring (16) is placed from one to the other of both the spring mounts (16*a*, 3*d*), so that the piston body (22) is resiliently supported in the cylinder member (4) so as to be capable of reciprocating motion.

Under the above structure, when an alternating current of a specific frequency (e.g., 50 Hz) is supplied to the coil (12, 12) in synchronization, both the pistons (6, 6) reciprocate in opposite directions at a natural frequency. As a result, a compressed gas generates in the compression room (7) in cycles. The above frequency of the alternating current is set in accordance with masses of respective pistons (6, 6) and a spring constant of the spring (14).

Figure 3:
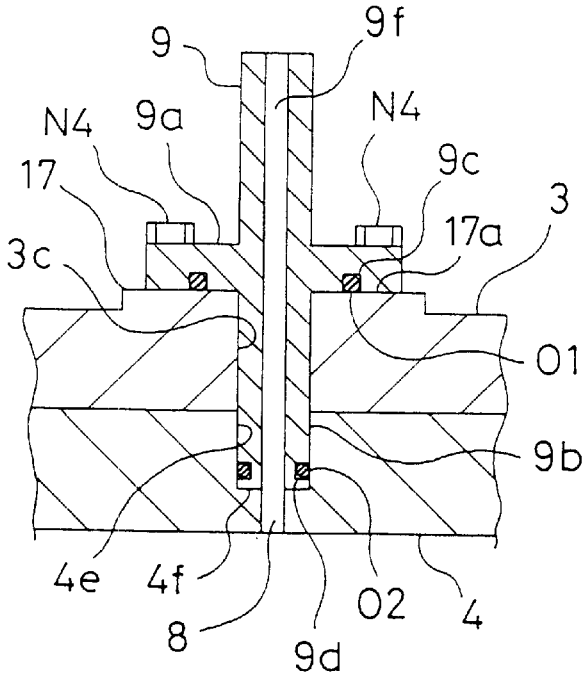
FIG. 3 is a cross section showing a joint of a connection pipe to the compressor of Embodiment 1 of the present invention.

A feature of the present embodiment lies in a joint structure of the connection pipe (9) to the compressor (1). Below, the joint structure is described with reference to FIG. 3. As shown in the figure, an insertion hole (3*c*) is formed in the casing (3). The insertion hole (3*c*) is formed in such a manner as to penetrate the casing (3) in a radial direction (vertical direction of FIG. 3). The insertion hole (3*c*) has the inner diameter approximately identical with the outer diameter of the connection pipe (9). Around the insertion hole (3*c*) on the outer periphery of the casing (3), a mount (17) having a plain mounting surface (17*a*) is formed. An insertion hole (4*e*) is formed in the cylinder (4). The insertion hole (4*e*) is formed outside from an approximately middle point in a thickness direction of the cylinder (4). The gas passage (8) is formed inside the insertion hole (4*e*). The insertion hole (4*e*) of the cylinder (4) is identical in diameter with the insertion hole (3*c*) of the casing (3). The insertion hole (4*e*) is communicated at an outer end thereof with the insertion hole (3*c*) of the casing (3) and at an inner end thereof with the gas passage (8). The gas passage (8) is formed smaller in diameter than the insertion holes (3*c*, 4*e*). Further, the insertion holes (3*c*, 4*e*) and the gas passage (8) are coaxially arranged in series. In this arrangement, a step part (4*f*) is formed between the insertion hole (4*e*) of the cylinder (4) and the gas passage (8).

Meanwhile, the connection pipe (9) has a flange (9*a*) contacting the mounting surface (17*a*) of the mount (17) and an insertion part (9*b*) located on an end side from the flange (9*a*). The insertion part (9*b*) is inserted into the insertion holes (3*c*, 4*e*). In this state, the flange (9*a*) contacts the mounting surface (17*a*) of the mount (17). Both the members (9*a*, 17) are jointed to each other by screws (N4, N4). A sealing groove (9*c*) is formed on the bottom surface of the flange (9*a*) which contacts the mount (17). The sealing groove (9*c*) is annularly formed so as to surround the insertion part (9*b*) of the connection pipe (9). A single O-ring (01) is fit into the sealing groove (9*c*). In other words, the single O-ring (01) is interposed between the mounting surface (17*a*) of the mount (17) and the flange (9*a*) of the connection pipe (9) so as to surround the connection pipe (9). This provides the structure of preventing a leakage of a gas refrigerant from a clearance between the connection pipe (9) and the casing (3) to the outside.

A sealing groove (9*d*) is also formed at the end of the insertion part (9*b*) of the connection pipe (9). The sealing groove (9*d*) is formed on the outer periphery of a portion of the connection pipe (9) located in the insertion hole (4*e*) of the cylinder (4). The sealing groove (9*d*) has an annular form over the circumference of the outer periphery of the connection pipe (9). A single O-ring (02) as a sealing means is fit into the sealing groove (9*d*). In other words, the O-ring (02) is interposed between the end of the connection pipe (9) and the cylinder (4) so as to surround the connection pipe (9). Thereby, sealing is established between the outer periphery of the connection pipe (9) and the inner periphery of the insertion hole (4*e*) of the cylinder (4). This provides the structure of preventing a leakage of a gas refrigerant from a clearance between the casing (3) and the cylinder (4) through a clearance between the connection pipe (9) and the insertion hole (4*e*). The O-ring (02) has the outer diameter approximately identical with the outer diameter of the connection pipe (9).

Next, description is made about the expander (2) to which a refrigerant is supplied through the connection pipe (9). As shown in FIG. 2, the expander (2) includes a cylinder (30) and a free displacer (31) reciprocatably inserted into the cylinder (30). The free displacer (31) divides an inner space of the cylinder (30) into an expansion room (30*a*) and an operational room (30*b*). In the operational room (30*b*), a displacer spring (32) formed of a coil spring is disposed. The displacer spring (32) resiliently supports the free displacer (31) to the cylinder (30). The inside of the free displacer (31) is filled with metallic cold storage material (31*a*). The free displacer (31) is provided at an expansion room (30) side end thereof with a first communication hole (31*b*). The first communication hole (31*b*) allows gas refrigerant communication with the expansion room (30*a*). On the other hand, the free displacer (31) is provided at an operational room (30*b*) side end thereof with a second communication hole (31*c*). The second communication hole (31*c*) allows gas refrigerant communication with the operational room (30*b*). The operational room (30*b*) is communicated with the compression room (7) of the compressor (1) through the connection pipe (9).

Next, description is made about operations of the Stirling refrigerating machine having the above-mentioned structure. During operation, an alternating current of a specific frequency (50 Hz) is supplied to both the coils (12, 12) of the linear motors (10, 10) of the compressor (1) in synchronization. By the supply of the alternating current, a magnetic field generated in the permanent magnet (11) and the cylinder (4) acts to reciprocate the coils (12, 12) and the pistons (6, 6). The reciprocations of the pistons (6, 6) are motions directed opposite to each other. In association with these motions, the springs (14, 14) become deformed. Thus, both the pistons (6, 6) synchronously move forward and backward in the cylinder (4) so that the volume of the compression room (7) is increased and decreased. Thereby, a pressure wave is produced in the compression room (7) in cycles. In the expander (2), the free displacer (31) reciprocates in the same cycle as in the pressure wave of the compression room (7), thereby causing gas expansion. The gas expansion in the expander (2) produces a cold condition. Such a reciprocating motion of the free displacer (31) is repeated, so that a cold head at the end of the cylinder (30) is cooled down to an extremely low temperature level.

In the above operation, a comparatively high-pressure gas refrigerant flows through the gas passage (8) and the internal passage (9*f*) of the connection pipe (9). As mentioned above with reference to FIG. 3, the contact part between the mount (17) of the casing (3) and the flange (9*a*) of the connection pipe (9), and the joint part between the outer periphery of the end of the connection pipe (9) and the cylinder (4) are sealed with the O-rings (01, 02), respectively. Further, the O-rings (01, 02) each have a comparatively small diameter and their sealed areas are set small. Accordingly, sufficient sealing functions are displayed in the sealed areas, thereby preventing a leakage of a gas refrigerant in each sealed area.

As mentioned so far, this embodiment is directed to prevent a gas refrigerant from leaking out of a clearance between the casing (3) and the cylinder (4). Further, the end part of the connection pipe (9) is inserted into the insertion holes (3*c*, 4*e*) respectively formed in the casing (3) and the cylinder member (4). Furthermore, the O-ring (02) is provided at the joint part between the outer periphery of the end of the connection pipe (9) and the cylinder (4). That is, the O-ring (02) is formed so as to have a small diameter approximately identical with the outer diameter of the connection pipe (9). This reduces a sealed area, resulting in increase in the reliability of the sealing function.

In this embodiment, the O-ring (02) is fit into the sealing groove (9*d*) formed at the end of the insertion part (9*b*) of the connection pipe (9). However, this invention is not limited to this structure and may be so composed that an O-ring is fit into a sealing groove formed on the inner periphery of the insertion hole (4*e*) of the cylinder (4).

EMBODIMENT 2

Next, description will be made about Embodiment 2 of the invention. The present embodiment is a modification of the sealing structure of the joint of the connection pipe (9) to the compressor (1). The other parts are the same as in the above-mentioned Embodiment 1. Therefore, here, description is made only about the sealing structure of the joint.

Figure 4:
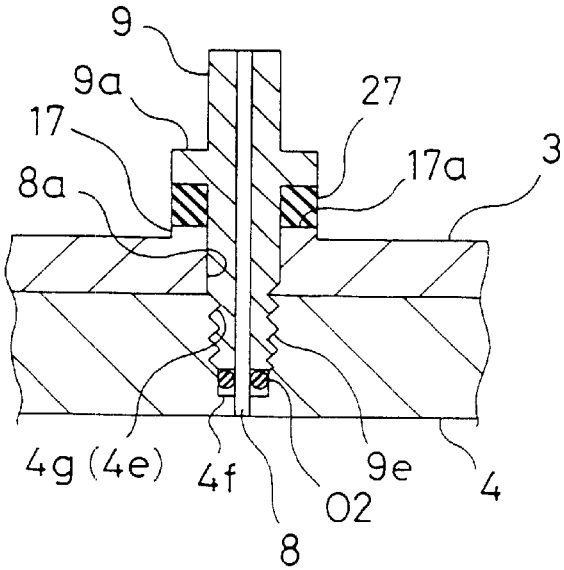
FIG. 4 is a diagram corresponding to FIG. 3 in Embodiment 2 of the present invention.

As shown in FIG. 4, a male thread (9*e*) is formed on the outer periphery of the end part of the connection pipe (9) of this embodiment, while a female thread (4*g*) capable of screw-in of the male thread (9*e*) is formed on the inner surface of the insertion hole (4*e*) of the cylinder (4). The male thread (9*e*) at the end part of the connection pipe (9) is screwed in the female thread (4*g*) of the insertion hole (4*e*), so that the connection pipe (9) is joined to the compressor (1). In this state of joint, an O-ring (02) is interposed between the end surface of the connection pipe (9) and the step part (4*f*). The O-ring (02) is adjusted so that the outer diameter thereof is approximately identical with the inner diameter of the insertion hole (4*e*) of the cylinder (4) and the inner diameter thereof approximately matches the inner diameter of the gas passage (8).

Further, between the flange (9*a*) of the connection pipe (9) and the mounting surface (17*a*) of the mount (17), a metal packing (27) is interposed. Thereby, a clearance between the connection pipe (9) and the casing (3) is sealed.

In the above structure, sealing between the mount (17) of the casing (3) and the flange (9*a*) of the connection pipe (9) is established by the metal packing (27), while sealing of the joint between the end part of the connection pipe (9) and the cylinder (4) is established by the O-ring (02). Also in this embodiment, the O-ring (02) has a comparatively small diameter and therefore a sealed area is set small. Accordingly, a sufficient sealing function can be displayed, thereby preventing a leakage of a gas refrigerant in each sealed are.

EMBODIMENT 3

Next, description will be made about Embodiment 3 of the present invention. The present embodiment is a modification of the sealing structure of the joint between the end part of the connection pipe (9) and the cylinder (4). The other parts are the same as in the above-mentioned Embodiment 2. Therefore, here, description is made only about the sealing structure of the joint.

Figure 5:
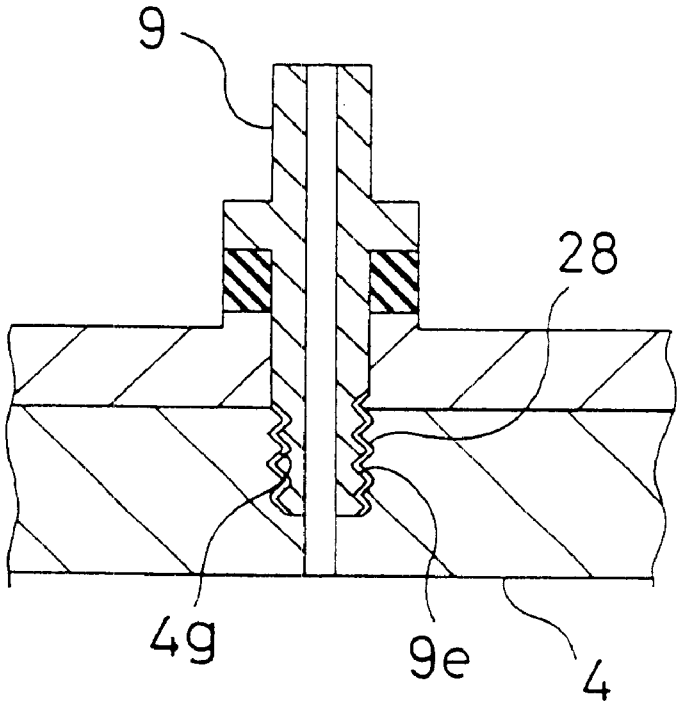
FIG. 5 is a diagram corresponding to FIG. 3 in Embodiment 3 of the present invention.
Figure 6:
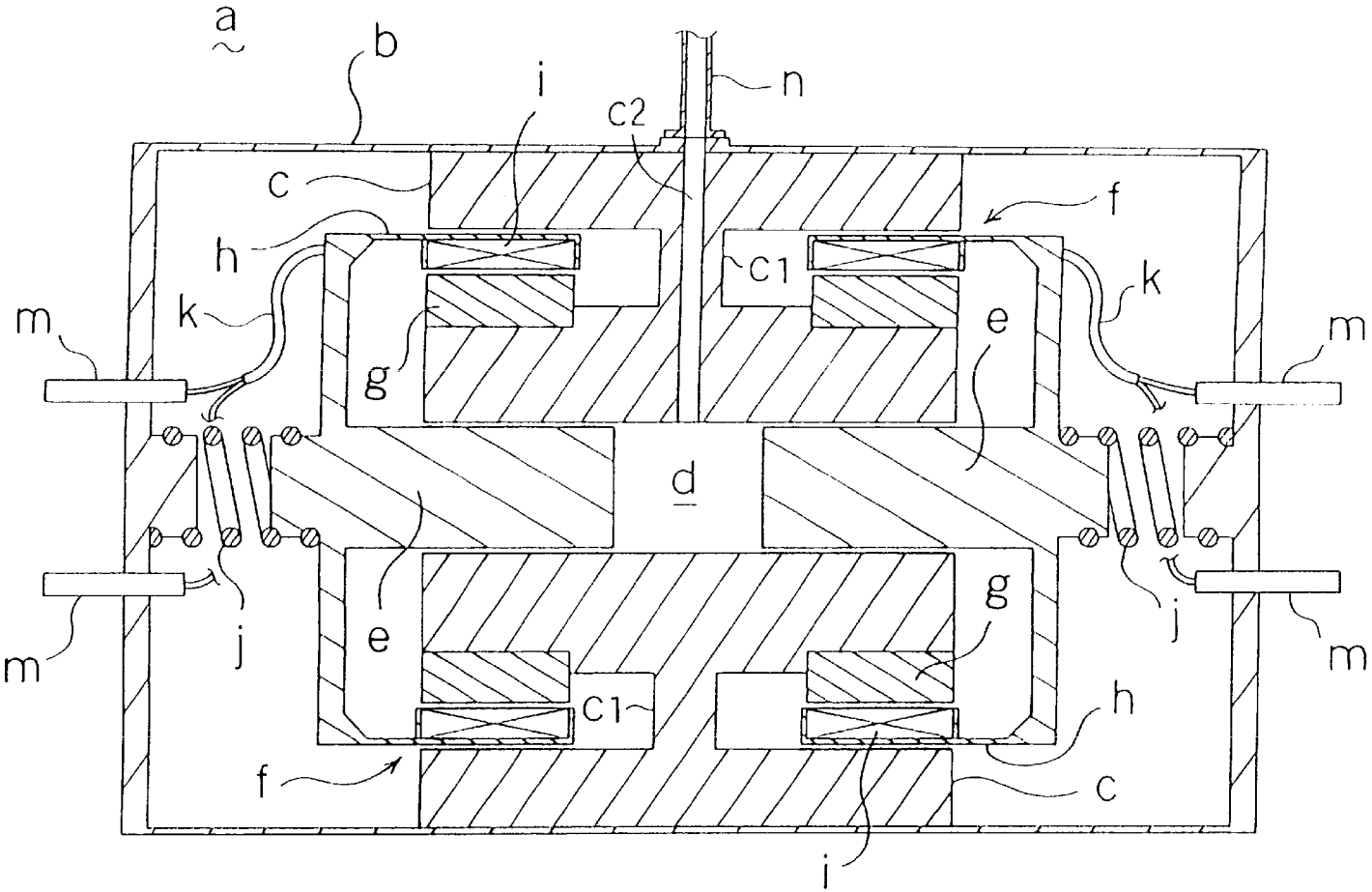
FIG. 6 is a diagram showing a conventional linear motor compressor, which corresponds to FIG. 1.
Figure 7:
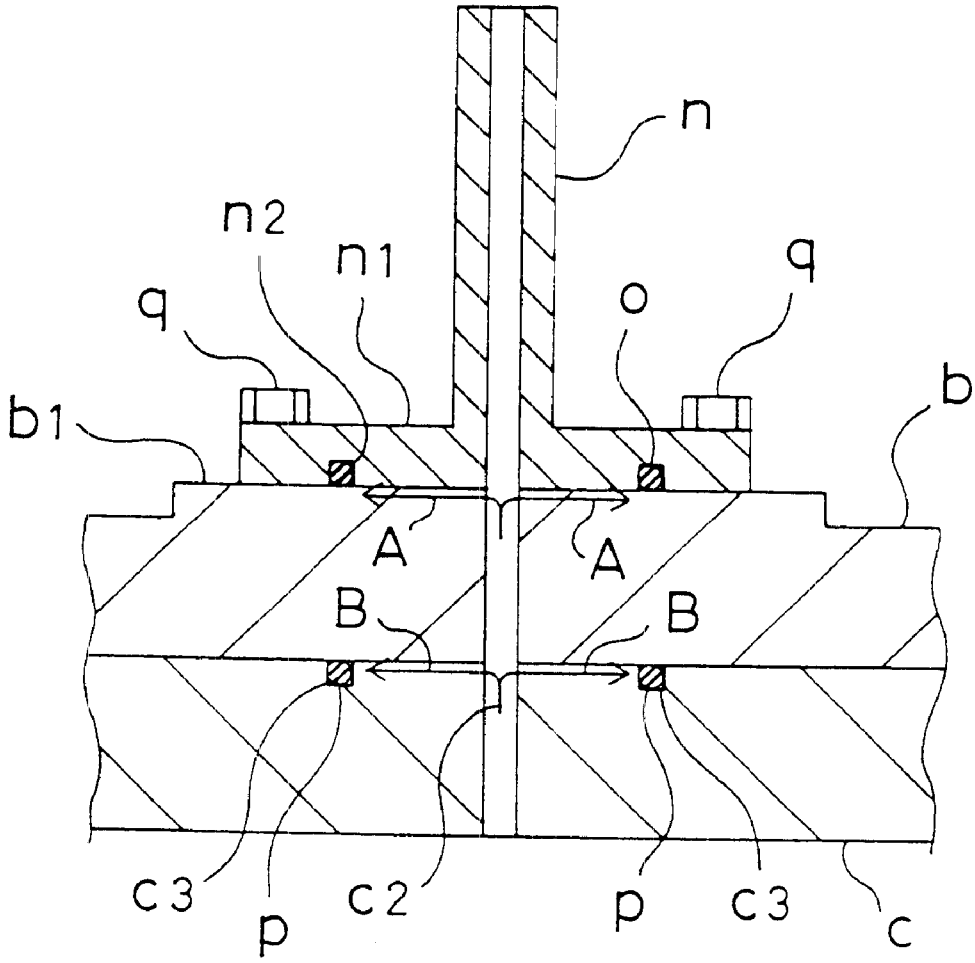
FIG. 7 is a diagram corresponding to FIG. 3 in the prior art.

As shown in FIG. 5, a clearance between the male thread (9*e*) formed on the outer periphery of the end part of the connection pipe (9) and the female thread (4*g*) formed in the cylinder (4), is filled with an adhesive agent (28) as a sealing means. The adhesive agent (28) implements the structure of displaying a high sealing function while securely obtaining a joint strength of a part that the male thread (9*e*) is screwed in the female thread (4*g*). This structure requires no O-ring, so that there is no need for a fitting work of an O-ring. This simplifies a work of joining the connection pipe (9) to the compressor (1).

OTHER EMBODIMENTS

The present invention is not limited to a non-contact type compressor which is designed to provide a small clearance between the cylinder (4) and the piston (6), that is, is applicable to a contact type compressor in which no small clearance is provided between the cylinder (4) and the piston (6).

INDUSTRIAL APPLICABILITY

A Stirling refrigerating machine of the present invention is useful for, in particular, application to an opposed-piston type compressor in which an internal pressure of a compression room is set high. In this case, a high-pressure gas produced in the compression room is transferred to an expander with efficiency.

What is claimed is:

1. A Stirling refrigeration machine having a compressor (1) and an expander (2), in which said compressor (1) comprises:

a cylinder (4) fit into a casing (3);

a piston (6) which is inserted into the cylinder (4) so as to be capable of reciprocating motion relative to the cylinder (4) and forms a compression room (7) between the piston (6) and the cylinder (4);

resilient means (14) for resiliently supporting the piston (6) on the casing (3); and drive means (10) for driving the piston (6) into reciprocating motion relative to the cylinder (4), wherein the compression is communicated with the expander (2) through a connection pipe (9), and wherein the drive means (10) relatively reciprocates the piston (6) with respect to the cylinder (4) so that a compressed fluid generated in the compression room (7) is introduced into the expander (2) trough the connection pipe (9), the improvement characterized in that:

the casing (3) has an insertion hole (3*c*) which penetrates the casing (3) and whose one end is open to the outer surface of the casing (3), while the cylinder (4) has an insertion hole (4*e*) which is communicated at one end with the insertion hole (3*c*) of the casing (3) and at the other end the compression room (7);

a compressor (1) side joint end part of the connection pipe (9) is inserted into the insertion hole (3*c*) of the casing (3) and the insertion hole (4*e*) of the cylinder (4) to communicate an internal passage (9*f*) of the connection pipe (9) with the compression room (7); and sealing means (02, 28) are interposed between an end part of the connection pipe (9), which is connected to said compressor (1), and the insertion hole (4*e*) of the cylinder (4) to prevent a leakage of the fluid from a clearance between the casing (3) and the cylinder (4) into the casing (1).

2. The Stirling refrigerating machine of claim 1, wherein an annular sealing groove (9*d*) is formed on one of the outer periphery of the connection pipe (9) located in the insertion hole (4*e*) of the cylinder (4) and the inner periphery of the insertion hole (4*e*) of the cylinder (4) so as to extend in a circumferential direction of the periphery, and the sealing means is formed of an O-ring (02) fit into the sealing groove (9*d*).

3. The Stirling refrigerating machine of claim 1, wherein the cylinder (4) is provided with a gas passage (8) coaxial with the insertion hole (4*e*) of the cylinder (4) and having a smaller diameter than the insertion hole (4*e*) of the cylinder (4), said gas passage (8) being communicated at one end with the compression room (7) and at the other end with the insertion hole (4*e*) through a step part (4*f*), the inner periphery of the insertion hole (4*e*) of the cylinder (4) is formed into a female thread (4*g*), while the outer periphery of the compressor (1) side joint end part of the connection pipe (9) located in the insertion hole (4*e*) of the cylinder (4) is formed into a male thread (9*e*) screwed in the female thread (4*g*), and the sealing means is formed of an O-ring (02) interposed between the end surface of the connection pipe (9) and the step part (4*f*).

4. The Stirling refrigerating machine of claim 1, wherein the inner periphery of the insertion hole (4*e*) of the cylinder (4) is formed into a female thread (4*g*), while the outer periphery of the compressor (1) side joint end part of the connection pipe (9) located in the insertion hole (4*e*) of the cylinder (4) is formed into a male thread (9*e*) screwed in the female thread (4*g*), and the sealing means is made of an adhesive agent (28) put in a clearance between the female thread (4*g*) and the male thread (9*e*).

5. The Stirling refrigerating machine of claim 1, wherein the connection pipe (9) has a flange (9*a*) formed in one piece with the connection pipe (9) and opposed to the outer surface of the casing (3), and a metal packing (27) is interposed between the outer surface of the casing (3) and the flange (9*a*).

* * * * *